US008978743B2

(12) United States Patent
Tamura et al.

(10) Patent No.: US 8,978,743 B2
(45) Date of Patent: Mar. 17, 2015

(54) FIN TUBE HEAT EXCHANGER

(75) Inventors: Tomoichiro Tamura, Osaka (JP); Kou Komori, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 393 days.

(21) Appl. No.: 13/496,775

(22) PCT Filed: Sep. 15, 2010

(86) PCT No.: PCT/JP2010/005637

§ 371 (c)(1), (2), (4) Date: Mar. 16, 2012

(87) PCT Pub. No.: WO2011/033767

PCT Pub. Date: Mar. 24, 2011

(65) Prior Publication Data

US 2012/0175101 A1 Jul. 12, 2012

(30) Foreign Application Priority Data

Sep. 16, 2009 (JP) ..... 2009-214877

(51) Int. Cl.

| | |
|---|---|
| ***F28D 1/04*** | (2006.01) |
| ***F28F 1/32*** | (2006.01) |
| ***F24F 1/18*** | (2011.01) |
| ***F28D 1/047*** | (2006.01) |
| ***F28F 19/00*** | (2006.01) |

(52) U.S. Cl.

CPC . *F28F 1/325* (2013.01); *F24F 1/18* (2013.01); *F28D 1/0477* (2013.01); *F28F 19/00* (2013.01); *F28F 2215/04* (2013.01)

USPC ..... 165/151; 165/182

(58) Field of Classification Search

USPC ..... 165/151, 181, 182

See application file for complete search history.

(56) References Cited

U.S. PATENT DOCUMENTS

| | | | | |
|---|---|---|---|---|
| 7,287,577 | B2 * | 10/2007 | Choi et al. | 165/151 |
| 7,578,339 | B2 * | 8/2009 | Kaga et al. | 165/151 |
| 2005/0016718 | A1 * | 1/2005 | Papapanu et al. | 165/151 |
| 2005/0045316 | A1 * | 3/2005 | Oh et al. | 165/166 |
| 2007/0151716 | A1 * | 7/2007 | Lee et al. | 165/151 |
| 2009/0151913 | A9 * | 6/2009 | Lakhdhar et al. | 165/151 |
| 2009/0199585 | A1 * | 8/2009 | Ogawa et al. | 62/324.2 |
| 2010/0000726 | A1 * | 1/2010 | Lee et al. | 165/181 |

FOREIGN PATENT DOCUMENTS

| | | |
|---|---|---|
| JP | 60-162194 | 8/1985 |
| JP | 2-217792 | 8/1990 |

(Continued)

*Primary Examiner* — Mohammad M Ali
*Assistant Examiner* — Raheena Rehman
(74) *Attorney, Agent, or Firm* — Hamre, Schumann, Mueller & Larson, P.C.

(57) ABSTRACT

A fin tube heat exchanger 1 according to the present invention includes fins 31 and a heat transfer tube 21 penetrating through the fins 31. A region that is surrounded by line segments connecting among two reference points BP and two leading edge reference points BPF is defined as a reference region. A region that is included in the reference region and located between an upstream reference line LU and a downstream reference line LD is defined as a specific region. Each fin 31 is provided with a cut-and-raised portion 12 having, in the specific region, another leading edge different from a leading edge 31*f*. The cut-and-raised portion is formed by cutting and raising a part of the fin 31.

6 Claims, 20 Drawing Sheets

(56) References Cited

FOREIGN PATENT DOCUMENTS

| | | |
|---|---|---|
| JP | 8-170889 | 7/1996 |
| JP | 8-170890 | 7/1996 |
| JP | 11-281279 | 10/1999 |
| JP | 2001-141383 | 5/2001 |
| JP | 2003-161588 | 6/2003 |
| JP | 2003-222486 | 8/2003 |
| JP | 2007-024419 | 2/2007 |

* cited by examiner

FIN TUBE HEAT EXCHANGER

TECHNICAL FIELD

The present invention relates to a fin tube heat exchanger.

BACKGROUND ART

Fin tube heat exchangers including a plurality of heat transfer fins (hereinafter simply referred to as "fins") arranged parallel to each other and a heat transfer tube penetrating through the fins are known well. Particularly, fins formed so that a peak and a trough are found alternately along an air flow direction is called "corrugated fins", which are used widely as high performance fins.

As fins other than the corrugated fins, the fins described in Patent Literatures 1 and 2 are known. The fins described in Patent Literatures 1 and 2 are obtained by forming cut-and-raised portions called "louvers". These fins are often called "louver fins" and widely used like the corrugated fins.

CITATION LIST

Patent Literature

PTL 1: JP 11(1999)-281279 A
PTL 2: JP 2001-141383 A

SUMMARY OF INVENTION

Technical Problem

As one of the problems in the case where a fin tube heat exchanger is used in an outdoor heat exchanger (evaporator) of a heat pump, frost formation on the fins under low temperature is known. As the frost is formed, an air passage is narrowed gradually, resulting in an increase in pressure loss and a decrease in heat transfer performance. Thus, the heat pump performs periodically an operation for removing the frost (so-called defrosting). If it is possible to reduce, without lowering the performance of the fin tube heat exchanger, the number of defrostings to be performed, the COP (coefficient of performance) of the cycle can be enhanced.

In view of the foregoing, the present invention is intended to provide a fin tube heat exchanger in which the increase in pressure loss and the decrease in heat transfer performance caused by frost formation are slow.

Solution to Problem

That is, the present invention provides a fin tube heat exchanger including:

a plurality of fins each having a linear leading edge, the fins being arranged parallel to each other at a specified interval to form flow passages for air; and a heat transfer tube through which a medium that exchanges heat with the air flows, the heat transfer tube penetrating through the fins.

When: a direction in which the fins are arranged is defined as a height direction; a direction parallel to the leading edge is defined as a width direction; a direction perpendicular to the height direction and the width direction is defined as an air flow direction; a diameter of a through hole formed in each fin in order to allow the heat transfer tube to pass therethrough is defined as $\phi$; a shortest distance from the leading edge to an upstream end of the heat transfer tube is defined as a; a point that is on a surface of the fin and located at a distance, in the width direction, of $0.8\phi$ from a center of the through hole is defined as a reference point; a flat plane that passes the reference point and is perpendicular to the width direction is defined as a reference plane; an intersection between the reference plane and the leading edge when the fin is viewed in plan is defined as a leading edge reference point; a region that is on the surface of the fin, surrounded by line segments connecting among two reference points and two leading edge reference points, and adjacent to the through hole is defined as a reference region; an imaginary line that is on the surface of the fin and located at a distance of 0.4a from the leading edge is defined as an upstream reference line; similarly a line at a distance of 0.6a from the leading edge is defined as a downstream reference line; and a region that is included in the reference region and located between the upstream reference line and the downstream reference line is defined as a specific region, the fin is provided with a cut-and-raised portion having, in the specific region, another leading edge different from the leading edge, the cut-and-raised portion being formed by cutting and raising a part of the fin.

Advantageous Effects of Invention

Usually, frost is not formed uniformly but grows locally on the surfaces of the fins. If the local growth of frost can be suppressed, the blocking of the air passage can be avoided over a long period of time and the decrease with time in heat transfer performance also is slowed.

The present inventors studied in detail the mechanism of frost formation in the fin tube heat exchanger. As a result, it has become clear that by suppressing the local frost formation on the leading edge of the fin, it is possible to slow the increase in pressure loss and the decrease in heat transfer performance caused by frost formation, and accordingly it is possible to reduce the number of defrostings to be performed.

According to the fin tube heat exchanger of the present invention, a cut-and-raised portion is formed by cutting and raising a part of the fin. The cut-and-raised portion has, in the specific region, another leading edge different from the leading edge of the fin. As is apparent from the later description, forming the cut-and-raised portion in this specific region makes it possible to suppress effectively the frost formation on the leading edge of the fin without decreasing the heat transfer performance of the fin. As a result, it is possible to slow the increase in pressure loss and the decrease in heat transfer performance caused by the frost formation on the leading edge of the fin and to reduce the number of defrosting processes to be performed.

DESCRIPTION OF EMBODIMENTS

Hereinafter, embodiments of the present invention are described in detail with reference to the drawings.

Embodiment 1

Figure 1:
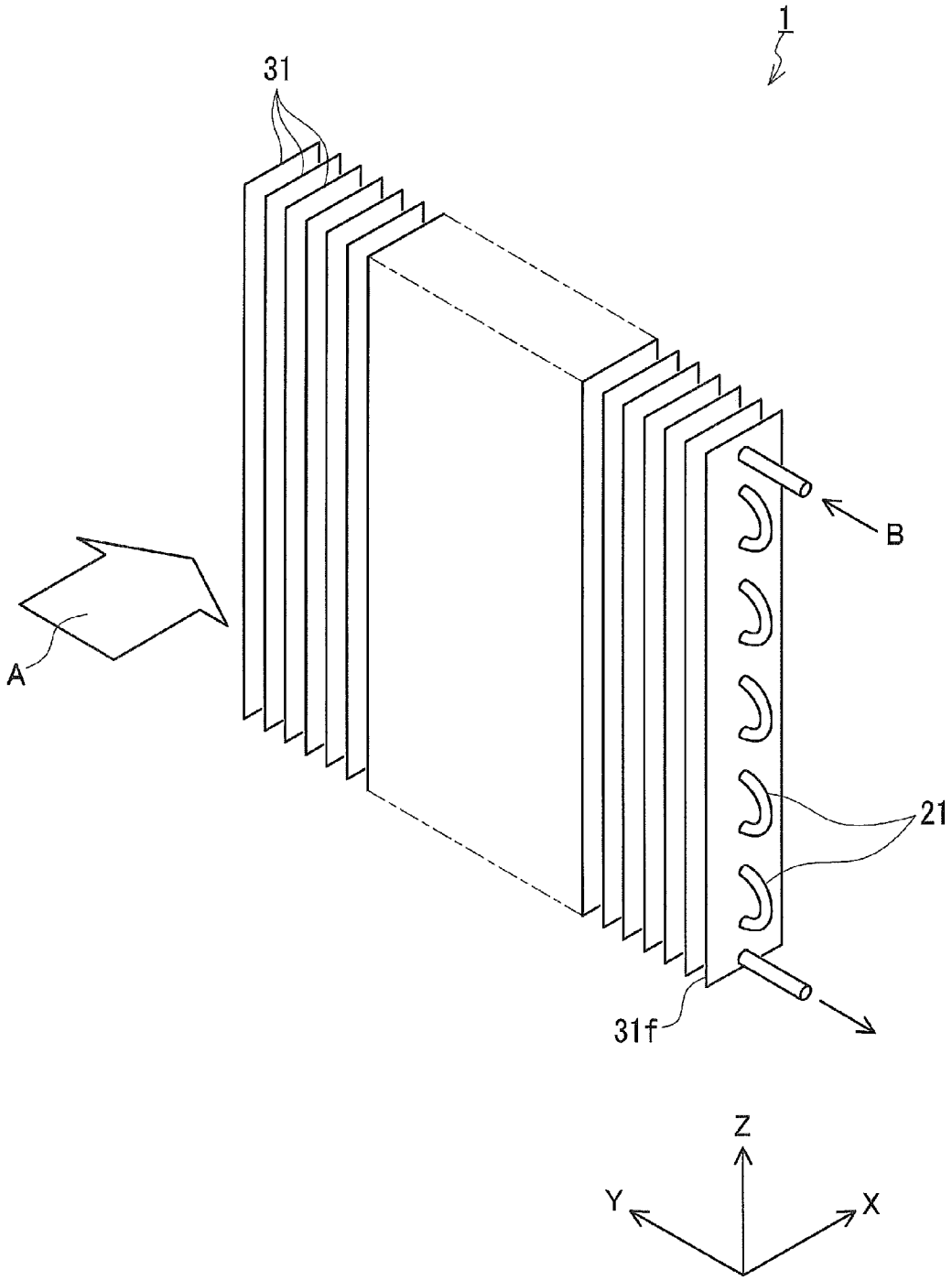
FIG. 1 is a perspective view of a fin tube heat exchanger according to Embodiment 1 of the present invention.

As shown in FIG. 1, a fin tube heat exchanger 1 of the present embodiment includes a plurality of fins 31 arranged parallel to each other at a specified interval (fin pitch) in order to form flow passages for air A, and a plurality of heat transfer tubes 21 penetrating through the fins 31. The fin tube heat exchanger 1 serves to exchange heat between a medium B flowing through the heat transfer tubes 21 and the air A flowing along surfaces of the fins 31. A specific example of the medium B is a refrigerant such as carbon dioxide and hydrofluorocarbon. The heat transfer tubes 21 may be or may not be connected into one piece.

Figure 2A:
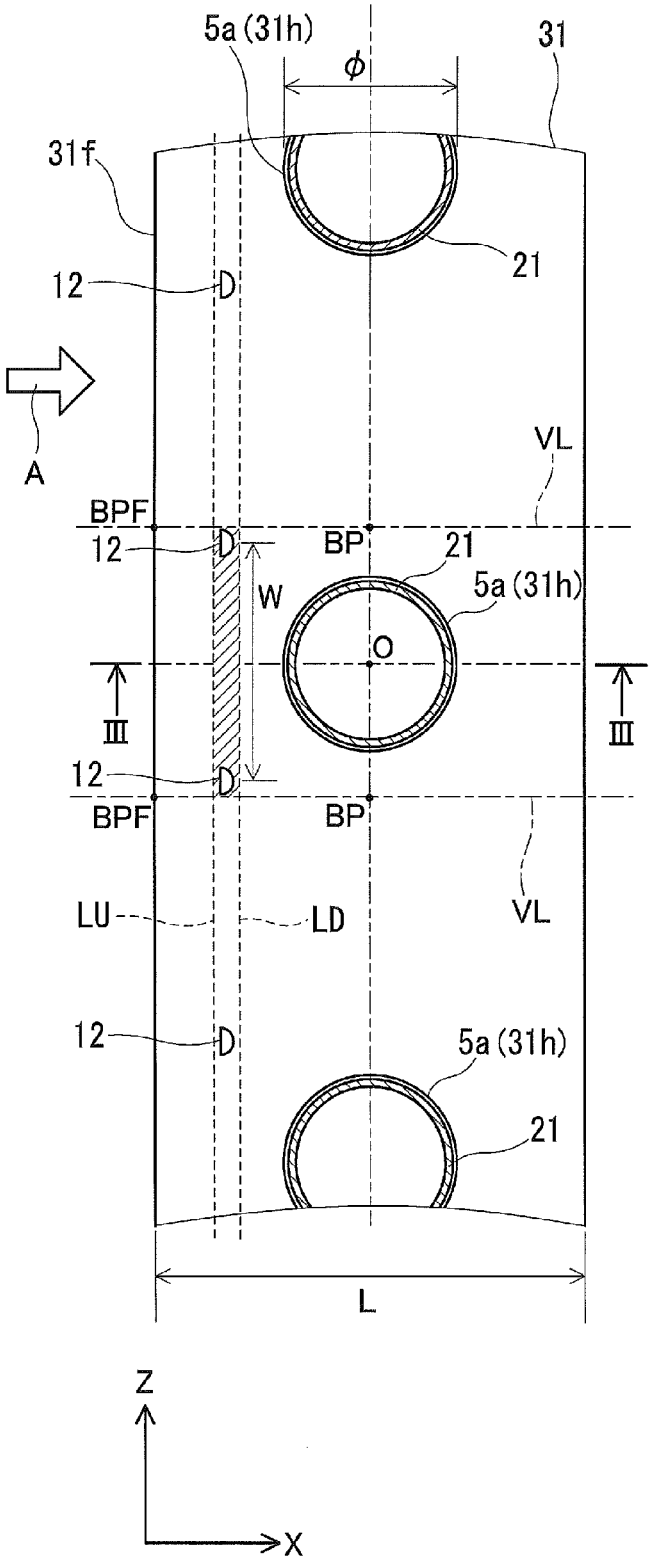
FIG. 2A is a plan view of a fin used in the fin tube heat exchanger shown in FIG. 1.

As shown in FIG. 2A, each fin 31 has a linear leading edge 31*f*. In this description, a direction in which the fins 31 are arranged is defined as a height direction, a direction parallel to the leading edge 31*f* (see FIG. 2A) is defined as a width direction, and a direction perpendicular to the height direction and the width direction is defined as an air flow direction. As shown in FIG. 1, the air flow direction, the height direction and the width direction correspond to X direction, Y direction and Z direction, respectively.

Each fin 31 has a rectangular and flat plate shape. The longer direction of the fin 31 coincides with the width direction. In the present embodiment, the fins 31 are arranged at a constant interval (fin pitch). However, the interval between two fins 31 adjacent to each other in the height direction does not necessarily have to be constant and may vary. As the material of the fins 31, a punched-out aluminum flat plate with a thickness of 0.05 to 0.8 mm can be used suitably, for example. From the viewpoint of enhancing the fin efficiency, etc., it is particularly preferable that each fin 31 has a thickness of 0.08 mm or more. The surface of the fin 31 may be subject to a hydrophilic treatment such as a boehmite treatment and coating with a hydrophilic paint.

As shown in FIG. 2A, the heat transfer tubes 21 are inserted into through holes 31*h* formed in each fin 31. A part of the fin 31 forms a fin collar 5*a* around each through hole 31*h*. The fin collar 5*a* is in close contact with the heat transfer tube 21. The through holes have a diameter ϕ of, for example, 1 to 20 mm, and it may be 4 mm or less. The diameter ϕ of the through holes 31*h* is the same as the outer diameter of the heat transfer tubes 21. Moreover, the fins 31 have a dimension L of, for example, 15 to 25 mm in the air flow direction.

On an upstream side of the air flow direction when viewed from the heat transfer tube 21, a cut-and-raised portion 12 having another leading edge different from the leading edge of the fin 31 is formed by cutting and raising a part of the fin 31. The leading edge of the cut-and-raised portion 12 is located in a specific region diagonally-shaded in the drawings, and is parallel to the width direction. Specifically, the through holes 31*h* are formed at a constant interval in the width direction, and at least one cut-and-raised portion 12 is formed for one through hole 31*h*. In the present embodiment, two (a plurality of the) cut-and-raised portions 12 are formed for one through hole 31*h*. Each cut-and-raised portion 12 has a semicircular shape in plan view. The entire cut-and-raised portion 12 having a semicircular shape in plan view may be located in the diagonally-shaded specific region as in the present embodiment, or a downstream part of the cut-and-raised portion 12 may extend out of the specific region. The other portion of the first fin 31 excluding the cut-and-raised portion 12 is flat and has a surface parallel to the air flow direction and the width direction.

Figure 2B:
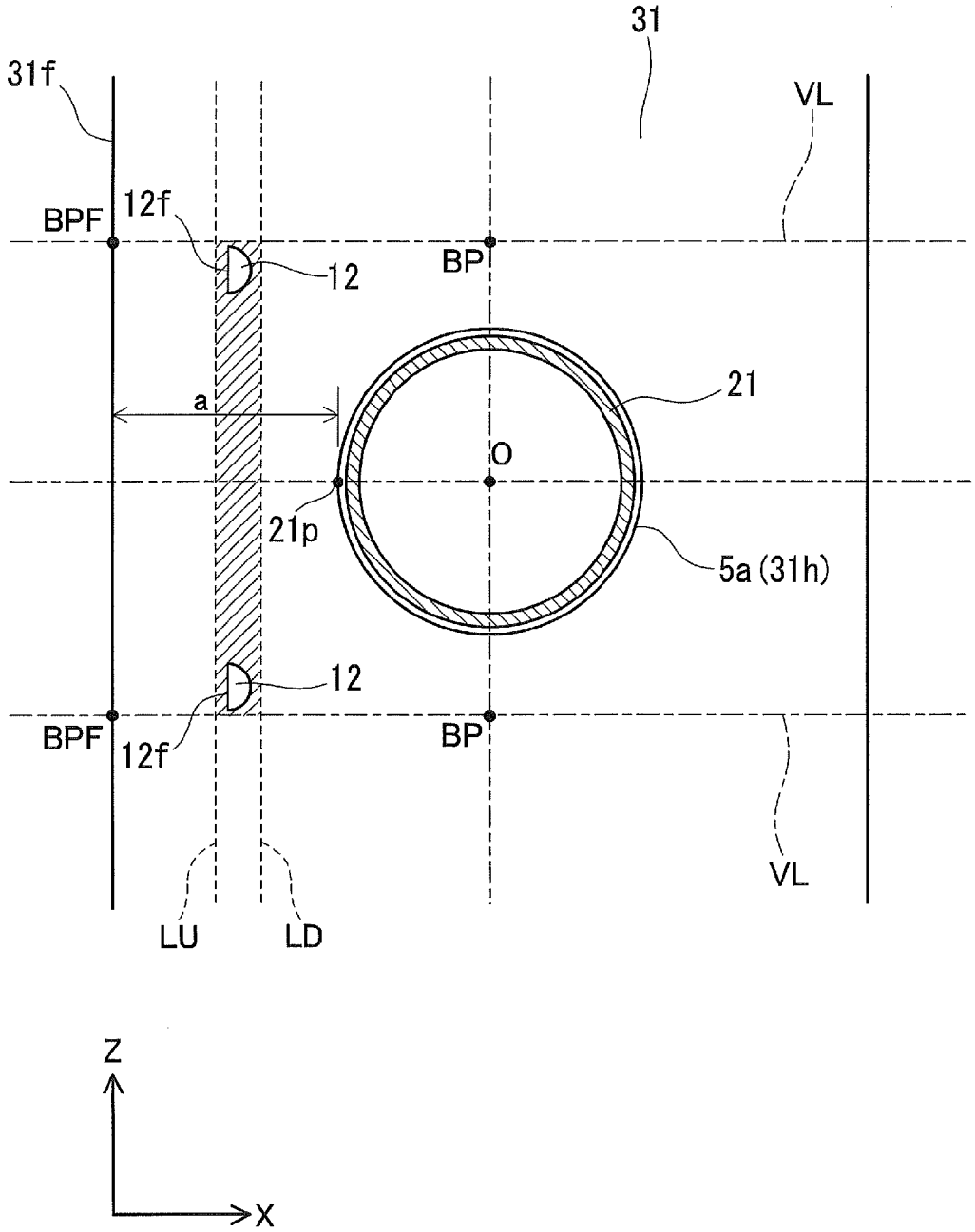
FIG. 2B is a partially enlarged view of FIG. 2A.

As shown in FIG. 2B, in the case where the leading edge 12*f* of the cut-and-raised portion 12 has a linear shape in plan view, a most upstream portion, in the air flow direction, of the cut-and-raised portion 12 is located in the specific region.

Figure 3:
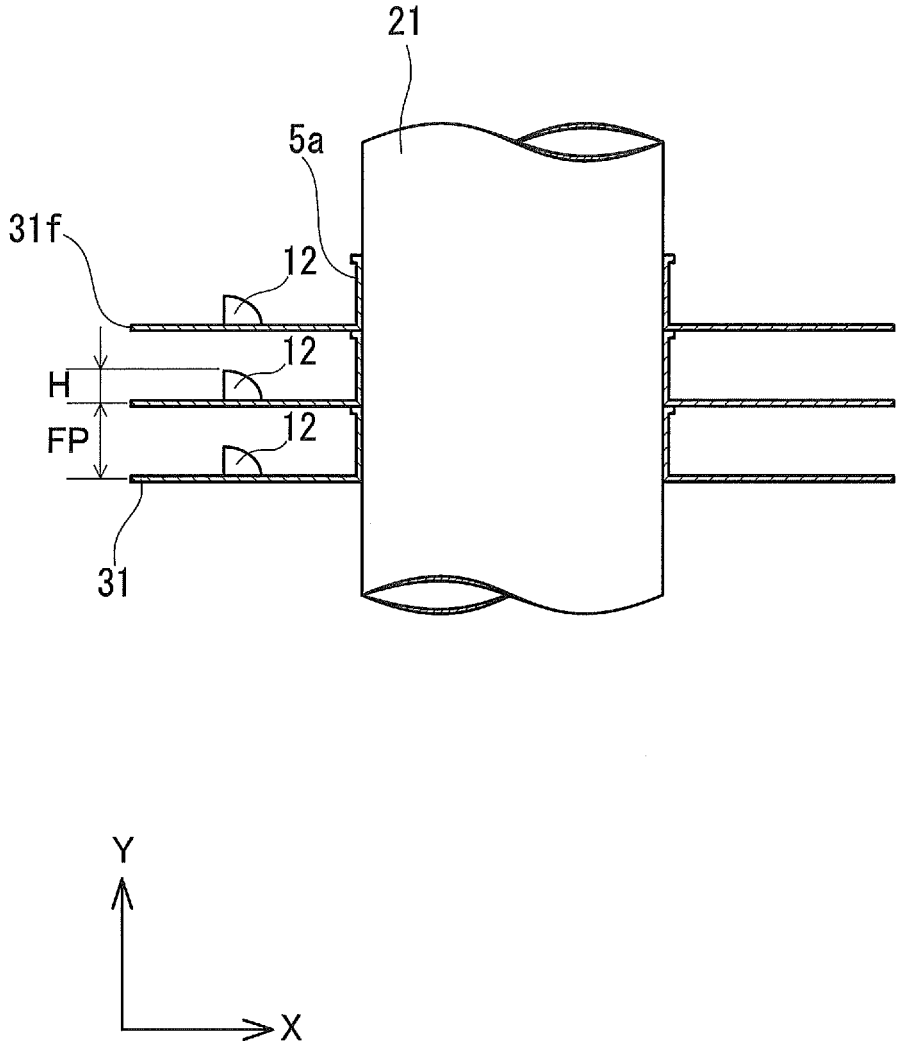
FIG. 3 is a cross-sectional view of the fin tube heat exchanger shown in FIG. 1, taken along the line III-III.

As shown in FIG. 3, when the fin pitch is referred to as FP, the cut-and-raised portions 12 have a height H of less than the fin pitch FP. Preferably, the height H is in a range of $0.4FP<H<0.6FP$. The "height H" means the height from the surface of the fin 31. The "fin pitch" means the interval at which the fins 31 are arranged when the thickness of the fins 31 is assumed to be zero. By adjusting appropriately the height H of the cut-and-raised portions 12, it is possible to suppress the decrease in the air flow speed when frost is formed on the leading edges of the cut-and-raised portions 12. Moreover, the cut-and-raised portions 12 do not disturb the assembly of the fin tube heat exchanger 1, and can be formed easily by press processing or the like.

Furthermore, as shown in FIG. 2A, an interval W between two cut-and-raised portions 12 adjacent to each other in the width direction is adjusted to be (FP)/2 or more. Preferably, the interval W is in a range of $0.5FP<W<5FP$. By adjusting appropriately the interval W between the cut-and-raised portions 12, it is possible to obtain sufficiently the effects of enhancing heat transfer performance and suppressing local frost formation on the leading edges 31*f* of the fins 31.

Figure 4A:
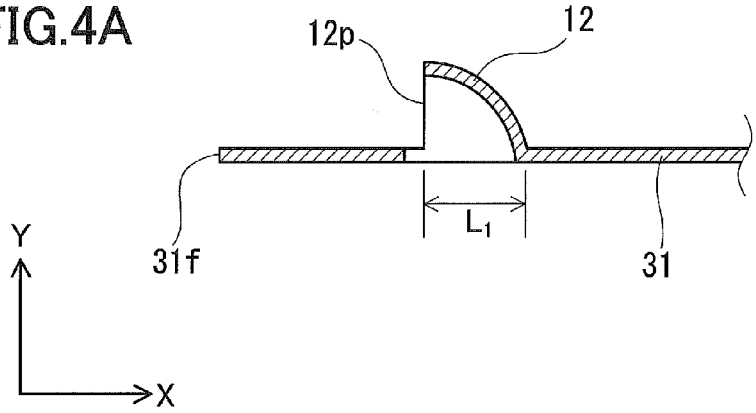
FIG. 4A is a cross-sectional view of the cut-and-raised portion along an air flow direction.
Figure 4B:
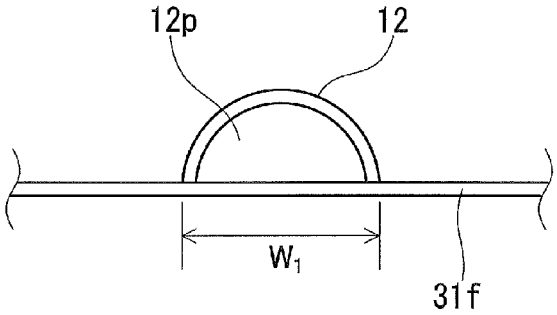
FIG. 4B is a front view of the cut-and-raised portion.
Figure 4C:
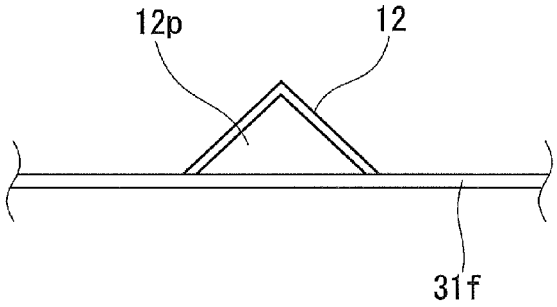
FIG. 4C is a front view of another example of the cut-and-raised portion.
Figure 4D:
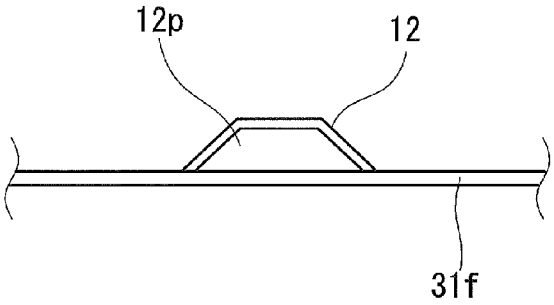
FIG. 4D is a front view of still another example of the cut-and-raised portion.

As shown in FIG. 4A, the cut-and-raised portion has an opening 12*p* capable of accepting the air from the upstream side of the air flow direction so as to allow the air to flow from a side of a first main surface of the fin 31 to a side of a second main surface of the fin 31. As shown in FIG. 4B, the opening 12*p* has a semicircular shape when viewed from the upstream side of the air flow direction. The cut-and-raised portion 12 has a dimension $L_1$ (length), in the air flow direction, of 0.5 to 1.5 mm, for example. The cut-and-raised portion 12 has a dimension $W_1$ (width), in the width direction, of 1.0 to 3.0 mm, for example. The shape of the opening 12*p* when viewed from the upstream side of the air flow direction is not limited to a semicircular shape, and it may be a polygonal shape, for example. Specifically, it may be a triangle shape as shown in FIG. 4C, or a trapezoid shape as shown in FIG. 4D. The number and shape of the cut-and-raised portions 12 can be determined appropriately so as to achieve desired heat transfer performance.

The specific region in which the leading edge of the cut-and-raised portion 12 is located is defined in accordance with the following criteria. As shown in FIG. 2A and FIG. 2B, the diameter of the through hole 31*h* is defined as ϕ. A shortest distance from the leading edge 31*f* of the fin 31 to an upstream end 21*p* of the heat transfer tube 21 is defined as a. A point that is on the surface of the fin 31 and located at a distance, in the width direction, of 0.8ϕ from a center O of the through hole 31*h* is defined as a reference point BP. A flat plane that passes the reference point BP and is perpendicular to the width direction is defined as a reference plane VL. An intersection between the reference plane VL and the leading edge 31*f* when the fin 31 is viewed in plan is defined as a leading edge reference point BPF. A region that is on the surface of the fin 31, surrounded by line segments connecting among two reference points BP and two leading edge reference points BPF, and adjacent to the through hole 31*h* is defined as a reference region. An imaginary line that is on the surface of the fin 31 and located at a distance of 0.4a from the leading edge 31*f* is defined as an upstream reference line LU. Similarly, a line at a distance of 0.6a from the leading edge 31*f* is defined as a downstream reference line LD. A region that is included in the reference region and located between the upstream reference line LU and the downstream reference line LD is defined as the specific region. In FIG. 2A, the specific region is diagonally shaded.

The reason for providing the cut-and-raised portion 12 in the specific region is explained. As a person skilled in the art knows, when the temperature of the fin (flat plate) is assumed to be constant, a local heat transfer coefficient α at an arbitrary position on the surface of the fin can be calculated by the following formula (1). In the formula (1), "Pr" refers to a Prandtl number, "λ" refers to the heat conductivity of the fin, "ν" refers to the kinematic viscosity of a fluid, "U" refers to the speed of the fluid, and "x" refers to the distance from the leading edge of the fin to a position at which the local heat transfer coefficient α is to be calculated.

$$\alpha=0.3332\times Pr^{1/3}\times\lambda\times\nu^{-1/2}\times U\times x^{-1/2} \quad \text{(Formula 1)}$$

Figure 5:
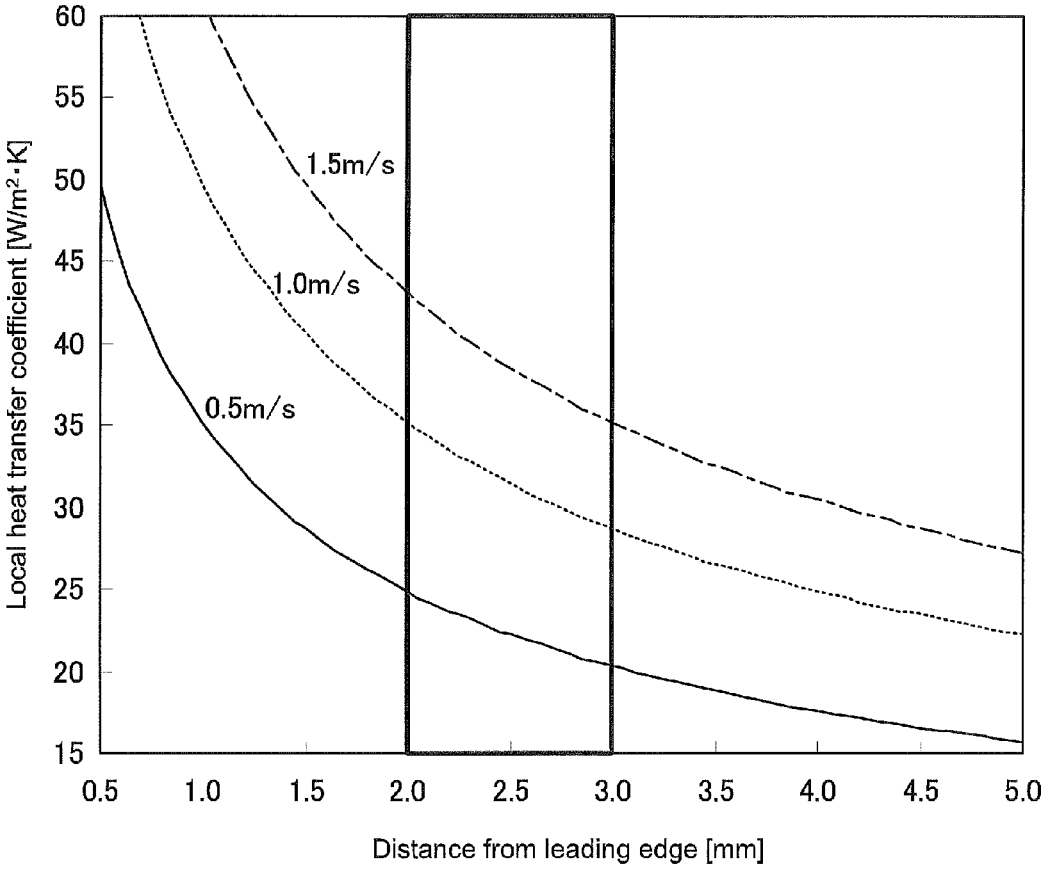
FIG. 5 is a graph showing a relationship between a distance from a leading edge of the fin and a local heat transfer coefficient.

According to the formula (1), the local heat transfer coefficient α depends on the distance from the leading edge of the fin. The change in the local heat transfer coefficient α with respect to the distance x from the leading edge of the fin was calculated based on the formula (1), under the conditions that the fluid was air, the fin was made of aluminum, the temperature was −5° C., and the shortest distance from the leading edge of the fin to the upstream end of the heat transfer tube was 5.0 mm. FIG. 5 shows the result. The graph in FIG. 5 indicates that the local heat transfer coefficient α decreases as the position is more distanced from the leading edge. Specifically, the decrease in the local heat transfer coefficient α becomes slow from around when the distance from the leading edge to the position exceeds 3.0 mm. This indicates that the thickness of a boundary layer is saturated around when the distance from the leading edge to the position exceeds 3.0 mm. Although the shape of the curve of the local heat transfer coefficient α changes in accordance with the speed U of the fluid, there remains the tendency of the local heat transfer coefficient α to drop sharply in a region relatively close to the leading edge.

Figure 6:
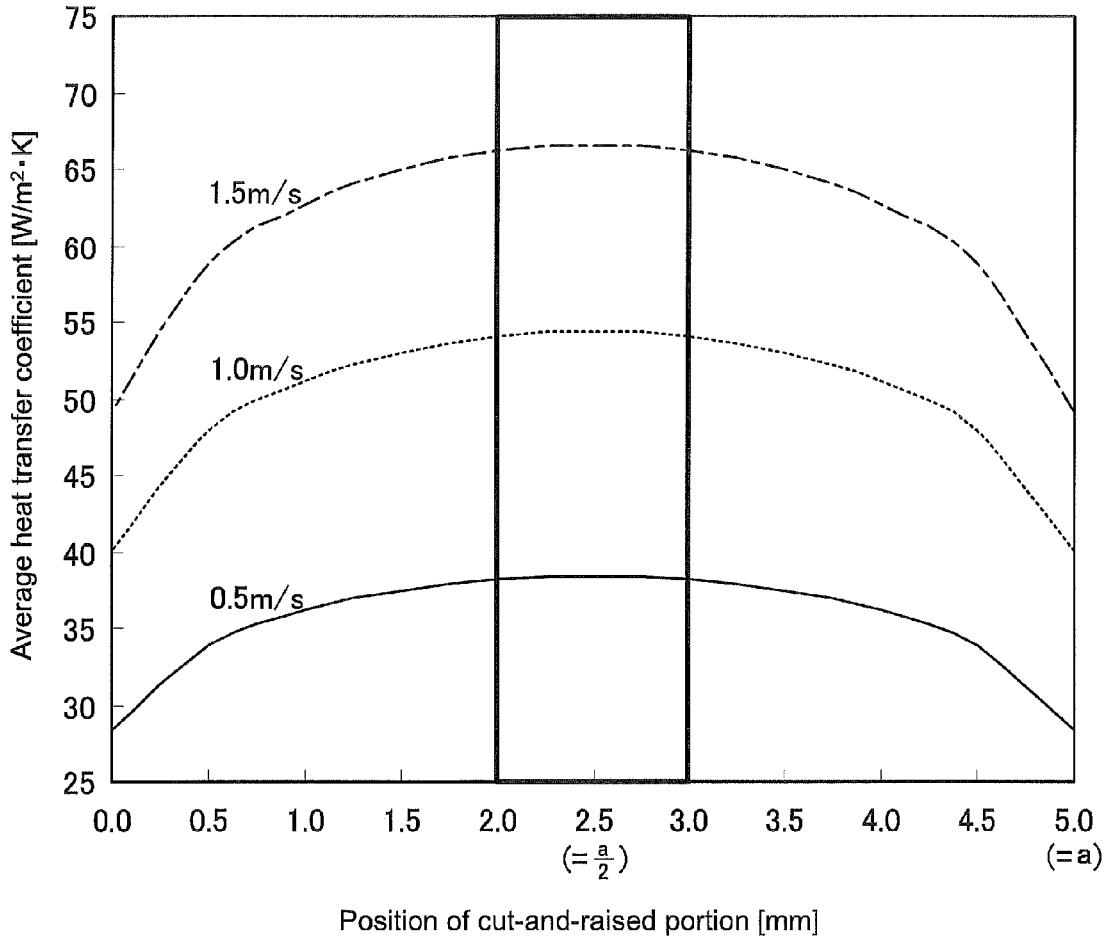
FIG. 6 is a graph showing a relationship between the position of the cut-and-raised portion and an average heat transfer coefficient.

Next, the change in the average heat transfer coefficient of the surface of the fin relative to the position of the cut-and-raised portion 12 was calculated in the case where the fin is provided with the cut-and-raised portion 12 described with reference to FIG. 2A, etc. In this calculation, the position of the cut-and-raised portion 12 was changed on a line passing the center O of the heat transfer tube 21 and parallel to the air flow direction. As the "average heat transfer coefficient", an average value of the local heat transfer coefficient from the leading edge of the fin to a position 5.0 mm downstream of the leading edge was calculated at each position of the cut-and-raised portion 12. FIG. 6 shows the results. To be exact, the "position of the cut-and-raised portion" means the distance from the leading edge of the fin to the leading edge of the cut-and-raised portion 12. As shown in FIG. 6, the average heat transfer coefficient of the fin is highest when the cut-and-raised portion 12 is provided at a position located at a distance of 2.5 mm from the leading edge of the fin, regardless of the speed of the fluid.

In the above-mentioned calculation, the distance from the leading edge of the fin to the upstream end of the heat transfer tube is set to 5.0 mm. However, the distance from the leading edge of the fin to the upstream end of the heat transfer tube is not particularly limited. As described below, with the distance from the leading edge of the fin to the upstream end of the heat transfer tube being defined as a, the highest heat transfer performance is obtained when the leading edge of the cut-and-raised portion 12 is set to a position located at a distance of a/2 from the leading edge of the fin.

Figure 7:
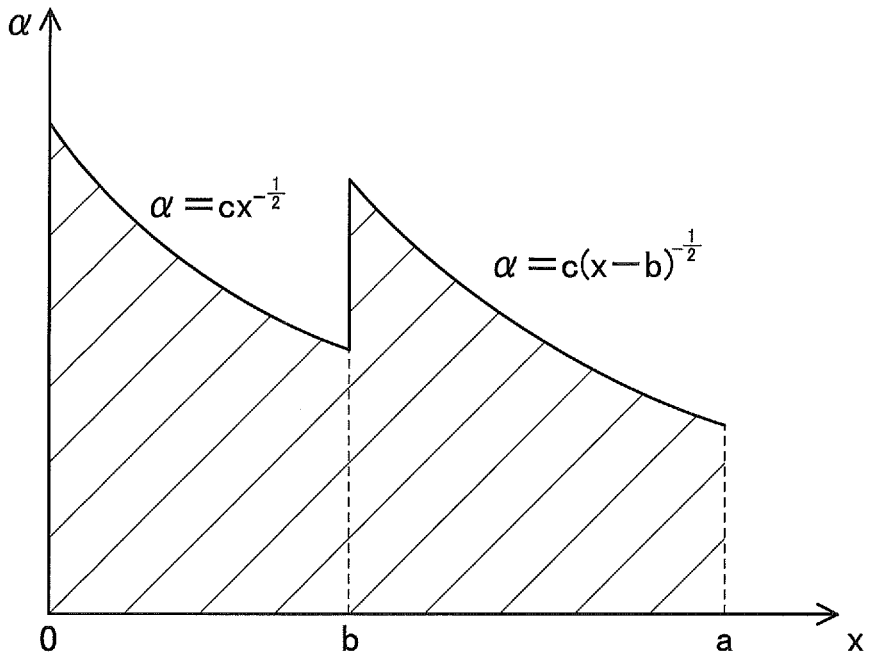
FIG. 7 is a graph showing the change in a local heat transfer coefficient α when the cut-and-raised portion is provided at a position located at a distance of b from the leading edge of the fin.

FIG. 7 shows the change in the local heat transfer coefficient α when the cut-and-raised portion is provided at a position located at a distance of b from the leading edge of the fin. The horizontal axis indicates a distance x from the leading edge of the fin to the cut-and-raised portion. The vertical axis indicates the local heat transfer coefficient α. When the distance from the leading edge of the fin to the upstream end of the heat transfer tube is defined as a, a value obtained by integrating the local heat transfer coefficient α from 0 to a provides an indication of the heat transfer performance of the fin, as represented by the following formula (2). In the formula (2), $c=0.3332\times Pr^{1/3}\times\lambda\times\nu^{-1/2}\times U$. In actual use of the fin tube heat exchanger, the dependencies of Pr, λ, ν and U on temperature are extremely low. Therefore, c can be regarded as a constant in the formula (2).

[Equation 1]

$$\int \alpha\, dx = \int_0^b cx^{-\frac{1}{2}}\, dx + \int_b^a c(x-b)^{-\frac{1}{2}}\, dx = 2c\left\{b^{\frac{1}{2}} + (a-b)^{\frac{1}{2}}\right\} \quad (2)$$

In the formula (2), $\{b^{1/2}+(a-b)^{1/2}\}$ obtains the maximum value when b=a/2. The fin has the highest heat transfer performance when the leading edge of the cut-and-raised portion 12 is set to a position located at a distance of a/2 from the leading edge of the fin.

Figure 8:
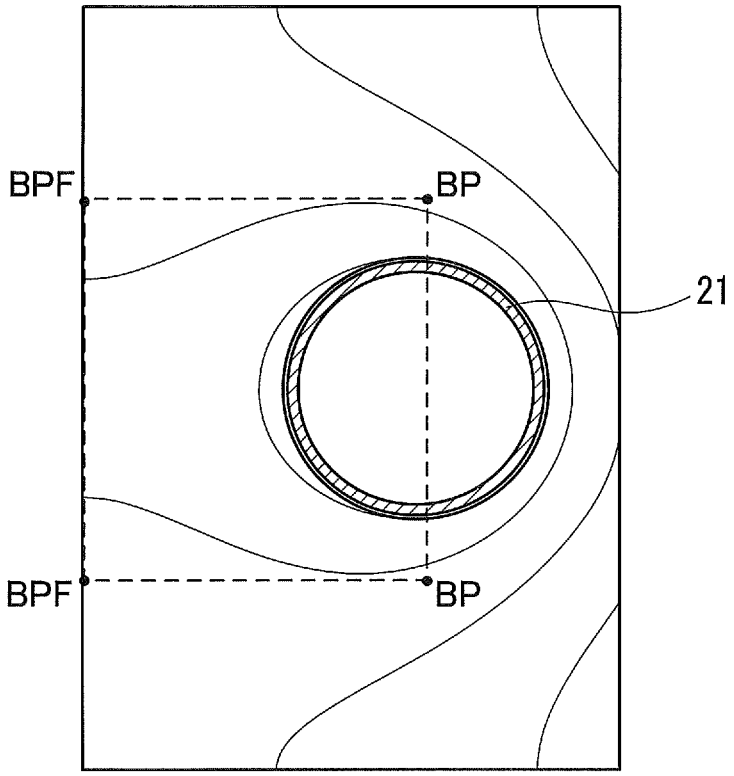
FIG. 8 is a contour plot showing the temperature distribution around a heat transfer tube.

Next, a fin tube heat exchanger including fins each formed only of a flat surface is prepared, and the surface temperature of the fins in the case where the fin tube heat exchanger is used as an evaporator was simulated. FIG. 8 shows the result. The contour plot in FIG. 8 indicates that the fins have a lower surface temperature at a portion closer to the heat transfer tube 21. As shown in FIG. 8, the surface of the fin has a low temperature in the region (reference region) that is surrounded by the line segments connecting among two reference points BP and two leading edge reference points BPF. That is, the difference between the temperature of the fin and that of the air is large in the reference region. Therefore, it is possible to increase the amount of heat exchange effectively by enhancing the heat transfer performance in the reference region.

Considering the above-mentioned results, it is possible to obtain both of the effect of suppressing the frost formation on the leading edge 31*f* and the effect of enhancing the heat transfer performance of the fin 31 by providing the cut-and-raised portion 12 so that the another leading edge 12*f* is present at the position located at a distance of a/2, when the shortest distance from the leading edge 31*f* of the fin 31 to the upstream end 21*p* of the heat transfer tube 21 is a. However, as is understand from FIG. 6, the curve of the average heat transfer coefficient is almost flat around the position located at a distance of a/2. Thus, the significant effects mentioned above can be obtained sufficiently also when the leading edge 12*f* of the cut-and-raised portion 12 is located at a distance of 0.4a to 0.6a from the leading edge 31*f* of the fin 31.

For example, in the case where a=5.0 mm, the cut-and-raised portion 12 is provided in the specific region that is located at a distance of 2 to 3 mm from the leading edge 31*f*. When the position of the cut-and-raised portion 12 is too close to the leading edge 31*f*, there is a problem in that it is difficult to form the cut-and-raised portion 12 by press processing. The press processing can be performed relatively easily on a portion located at a distance of 2 to 3 mm from the leading edge 31*f*. In the present embodiment, a portion located at a distance of less than 0.4a from the leading edge 31*f* does not have the other leading edge and is formed only of a flat surface. Likewise, a portion located at a distance of more than 0.6a but a or less from the leading edge 31*f* does not have the other leading edge and is formed only of a flat surface. Therefore, according to the present embodiment, it is possible to design the fin 31 that is easy to produce while achieving sufficiently the effects of suppressing an increase in the pressure loss caused by frost formation and enhancing the heat transfer performance.

Modified Embodiment

Figure 9A:
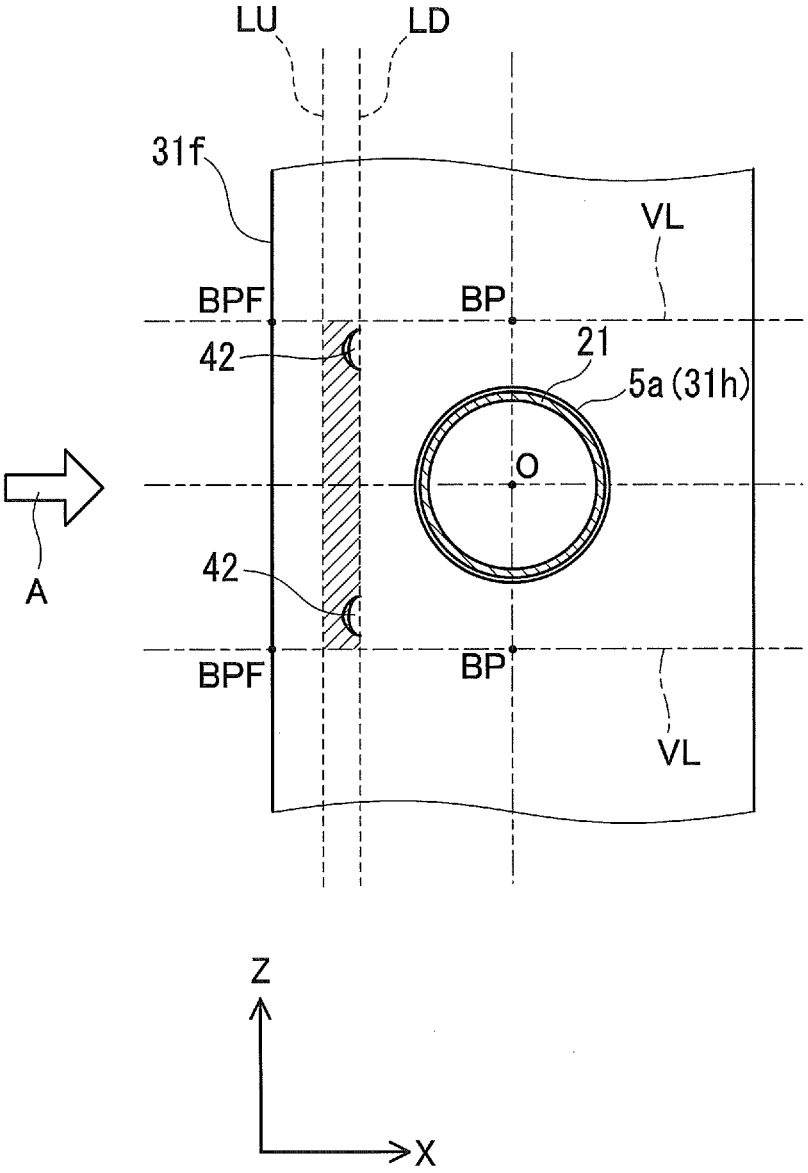
FIG. 9A is a plan view showing another preferable shape of the cut-and-raised portion.
Figure 9B:
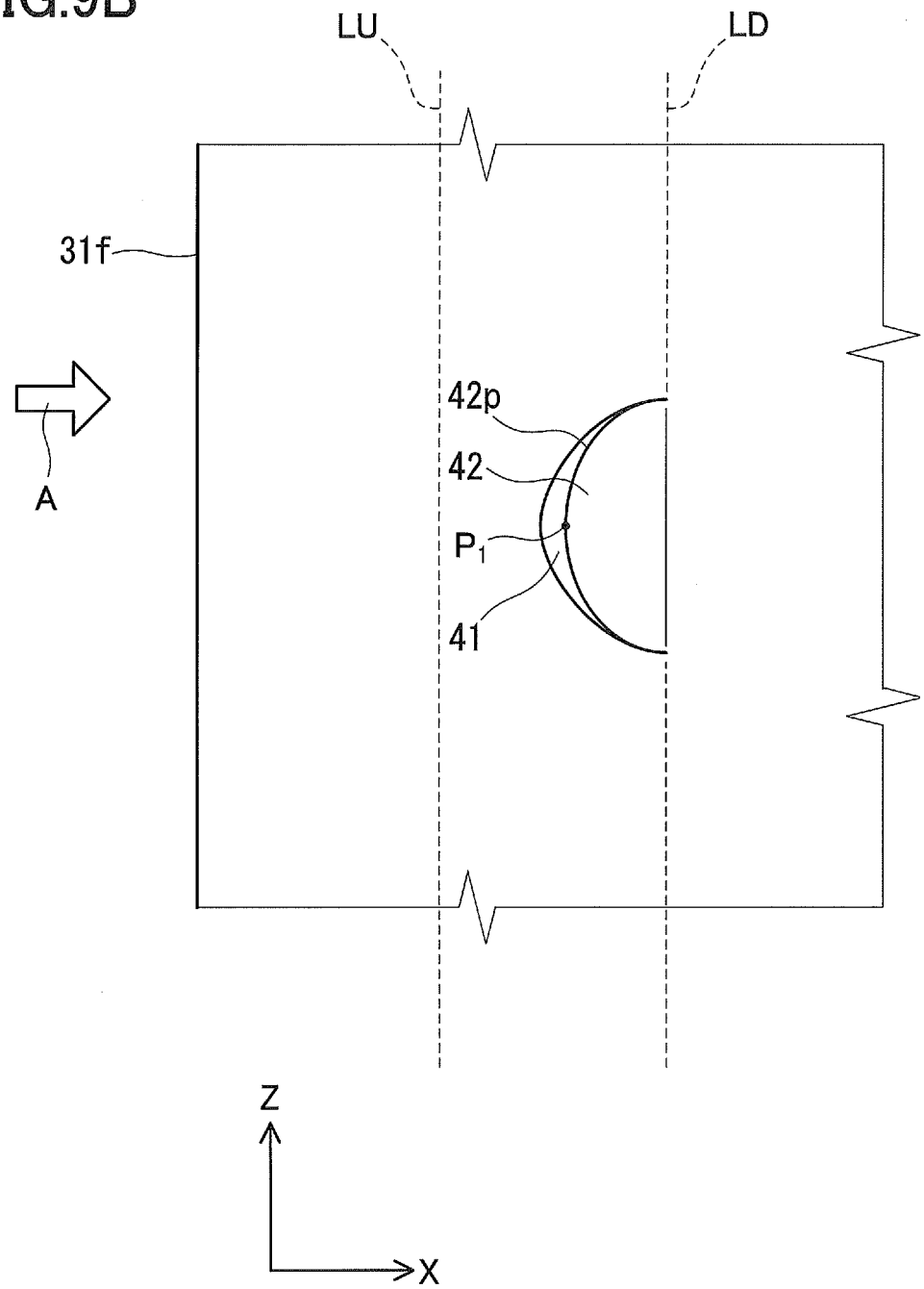
FIG. 9B is a partially enlarged view of FIG. 9A.

The leading edge of the cut-and-raised portion may have a shape other than a linear shape in plan view. In the modified embodiment shown in FIG. 9A, there is provided a cut-and-raised portion 42 having a shape that is convex, in plan view, toward the upstream side. Specifically, as shown in FIG. 9B, a leading edge 42*p* of the cut-and-raised portion 42 has a curved line (such as an arc) shape that is convex, in plan view, toward the upstream side of the air flow direction. The cut-and-raised portion 42 has an opening 41 capable of accepting the air from the upstream side of the air flow direction so as to allow the air to flow from the side of the first main surface of the fin 31 to the side of the second main surface of the fin 31. The opening 41 has a crescent shape in plan view. A most upstream portion $P_1$ of the leading edge 42*p* is located in the specific region. Such a shape also makes it possible to obtain the significant effects mentioned above. The curved line shape of the leading edge 42*p* makes it easy to process the fin.

Embodiment 2

It is possible to fabricate the fin tube heat exchanger by combining the fin described in Embodiment 1 with another fin. Hereinafter, the same components as those in Embodiment 1 are designated by the same reference numerals and the descriptions thereof are omitted.

Figure 10:
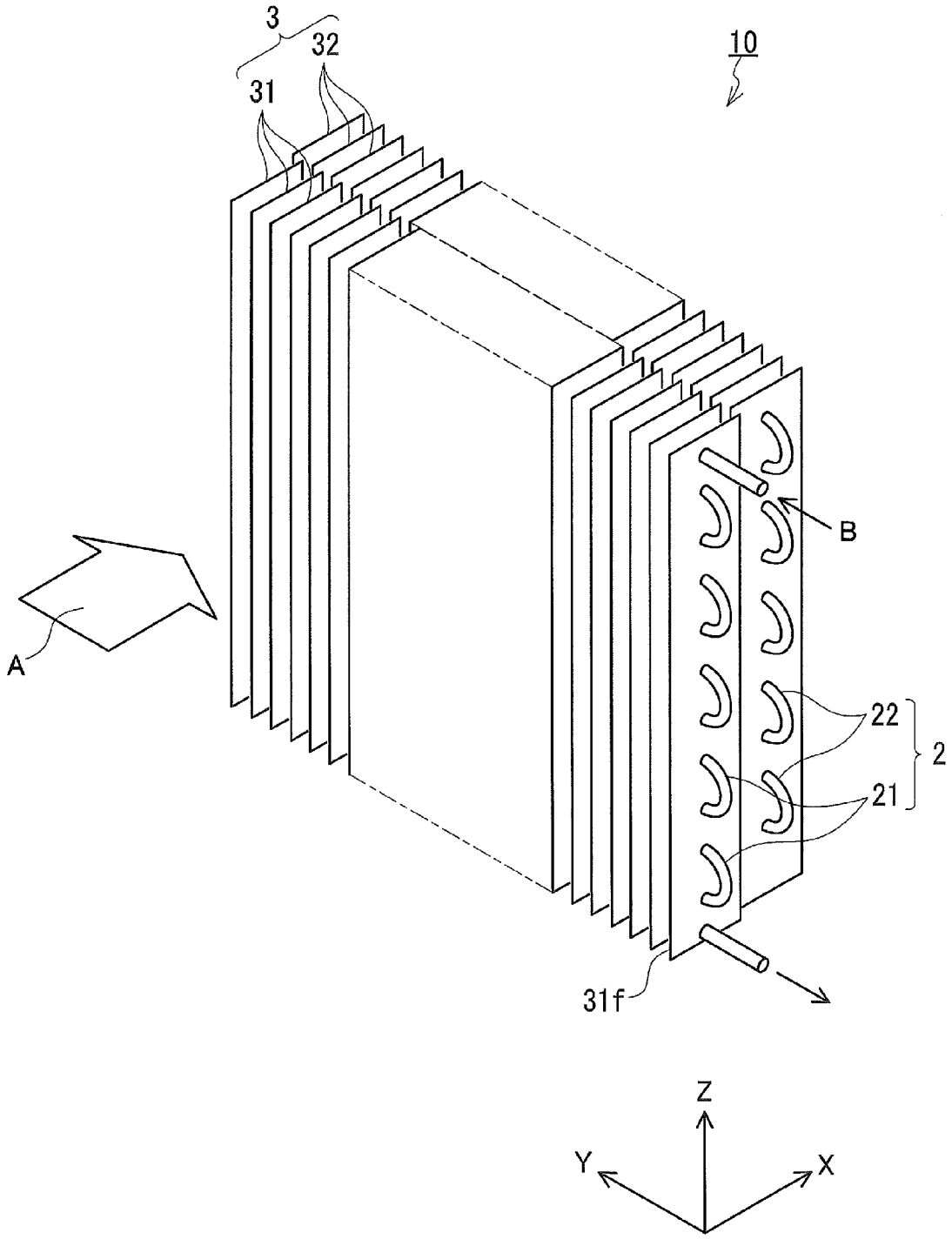
FIG. 10 is a perspective view of a fin tube heat exchanger according to Embodiment 2 of the present invention.

As shown in FIG. 10, a fin tube heat exchanger 10 of the present embodiment includes a plurality of fins 3 arranged parallel to each other at a specified interval in order to form the flow passages for the air A, and a plurality of heat transfer tubes 2 penetrating through the fins 3.

Figure 11:
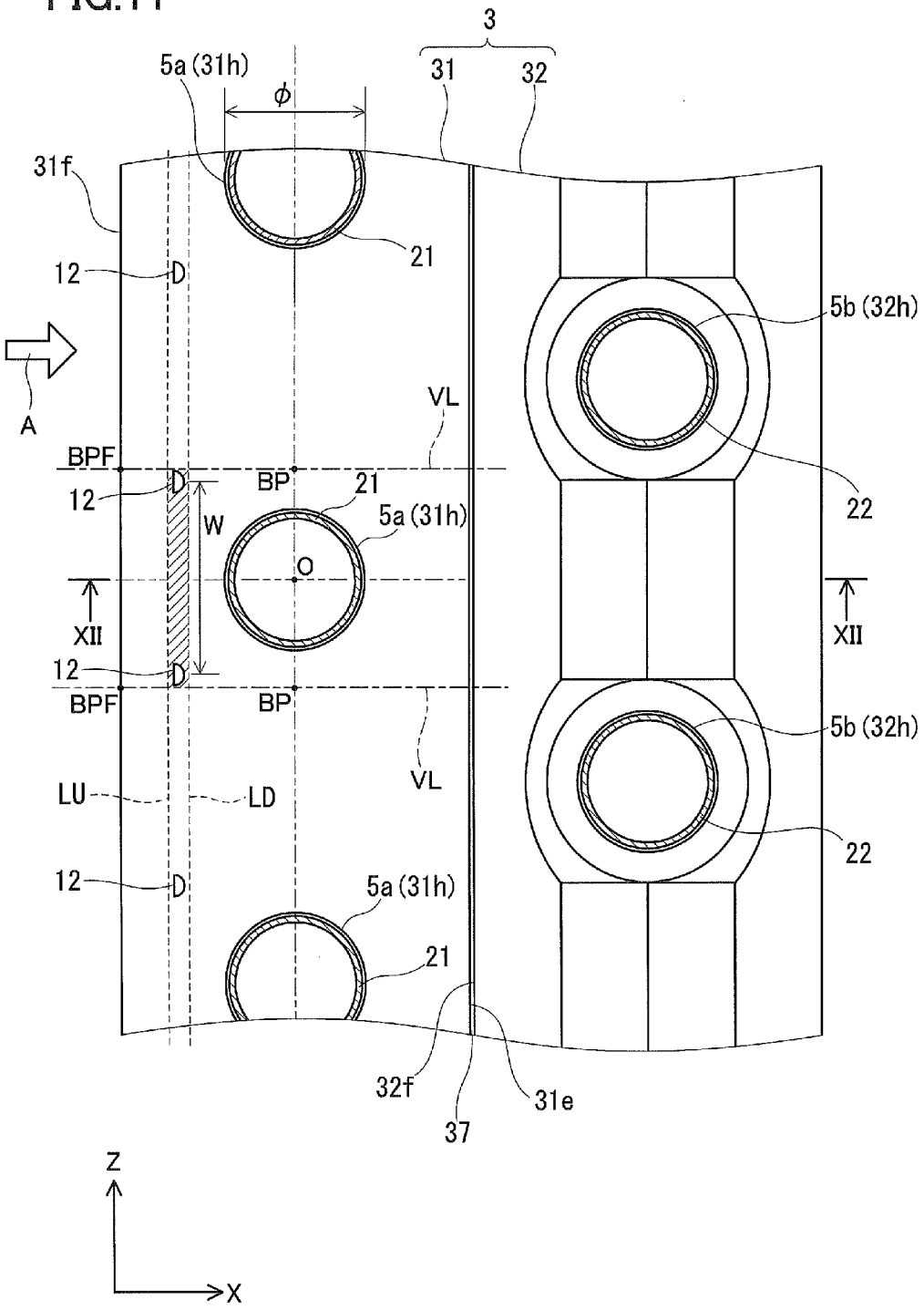
FIG. 11 is a plan view of a fin used in the fin tube heat exchanger shown in FIG. 10.

As shown in FIG. 10 and FIG. 11, the fins 3 include a plurality of the first fins 31 disposed on the upstream side of the air flow direction, and a plurality of second fins 32 disposed on a downstream side of the first fins 31 so as to allow the air A that has passed through the first fins 31 to flow therein. As described in Embodiment 1, each first fin 31 has the cut-and-raised portion 12. The dimensions of the first fin 31 (see diagram 2A) and those of each second fin 32 may be the same as or different from each other in the air flow direction. However, it is preferable that they are the same as each other in order to increase the mass production effect.

As shown in FIG. 10 and FIG. 11, the heat transfer tubes 2 include a plurality of the first heat transfer tubes 21 provided to the first fins 31 so as to be arranged in the width direction, and a plurality of second heat transfer tubes 22 provided to the second fins 32 so as to be arranged also in the width direction. The first heat transfer tubes 21 and the second heat transfer tubes 22 are disposed staggeredly in the width direction. Like the first heat transfer tubes 21, the second heat transfer tubes 22 are inserted into the through holes 31*h* formed in each second fin 32, and are in close contact with fin collars 5*b* each formed by a part of the second fin 32.

Figure 12:
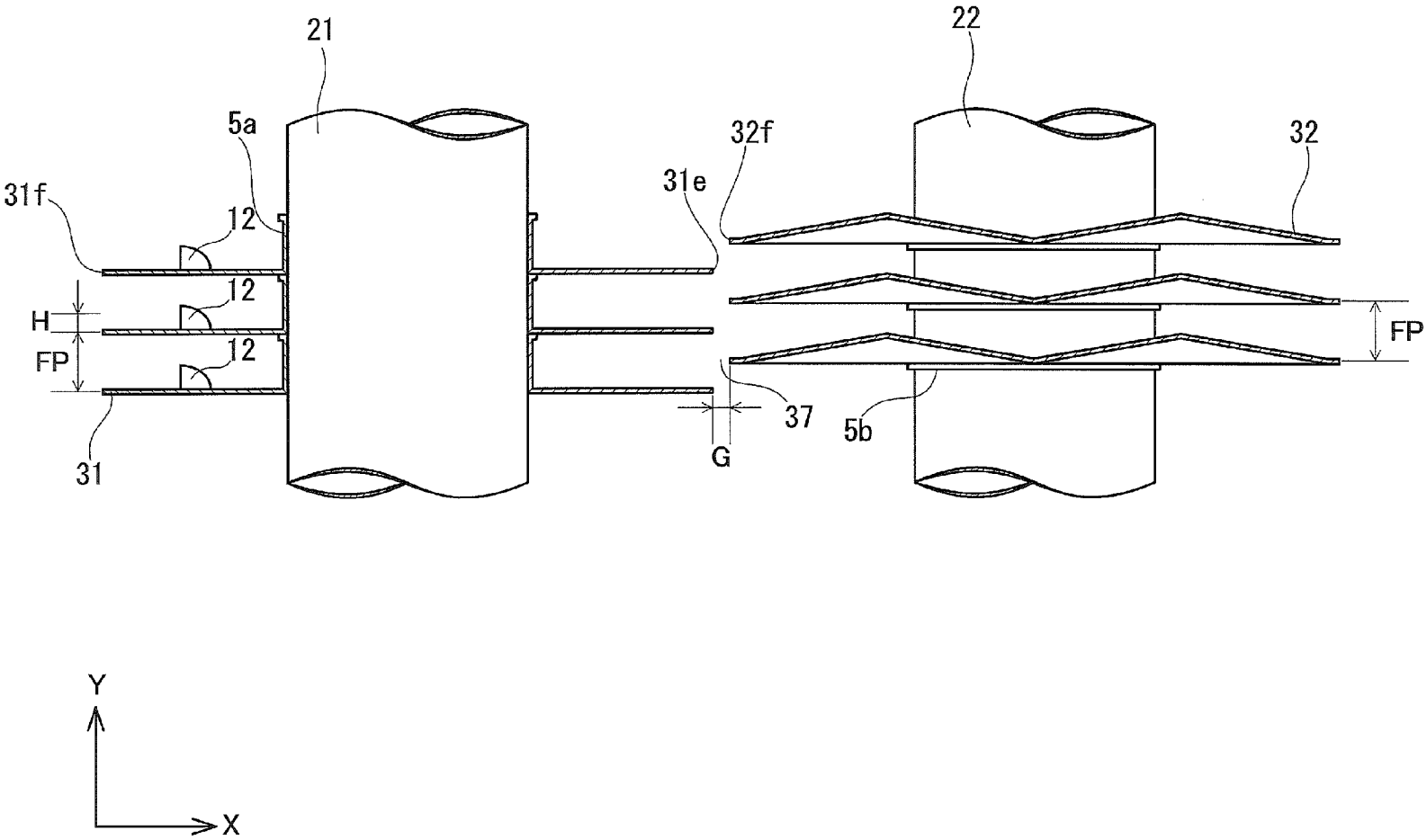
FIG. 12 is a cross-sectional view of the fin tube heat exchanger shown in FIG. 10, taken along the line XII-XII.

As shown in FIG. 12, a gap 37 with a width G of, for example, 1 to 3 mm in the air flow direction is formed between downstream ends 31*e* of the first fins 31 and leading edges 32*f* (upstream ends) of the second fins 32. The gap 37 serves a role of preventing frost from being formed across the downstream ends 31*e* of the first fins 31 and the leading edges 32*f* (upstream ends) of the second fins 32 and blocking the air passage. That is, the gap 37 can suppress an increase in the pressure loss that occurs when the frost is formed. Moreover, the presence of the gap 37 prevents the leading edges 32*f* of the second fins 32 from being shaded by downstream end portions of the first fins 31, thereby increasing the amount of heat exchange at the second fins 32.

As shown in FIG. 12, in the present embodiment, the second fins 32 each is a corrugated fin formed so that a peak and a trough are found alternately along the air flow direction. The fin pitch FP of the first fins 31 is the same as a fin pitch of the second fins 32, and the first fins 31 and the second fins 32 are arranged staggeredly in the height direction. Such an arrangement allows the leading edge 32*f* of the second fin 32 to face the air passage between two adjacent first fins 31. The air maintained at a high flow speed hits the leading edge 32*f* of the second fin 32, thereby enhancing the heat transfer coefficient at the leading edge 32*f* of the second fin 32 and increasing the amount of heat exchange at the second fins 32. As the fins on the downstream side, the first fins 31 provided with the cut-and-raised portions 12 may be used.

Modified Embodiment

Figure 13:
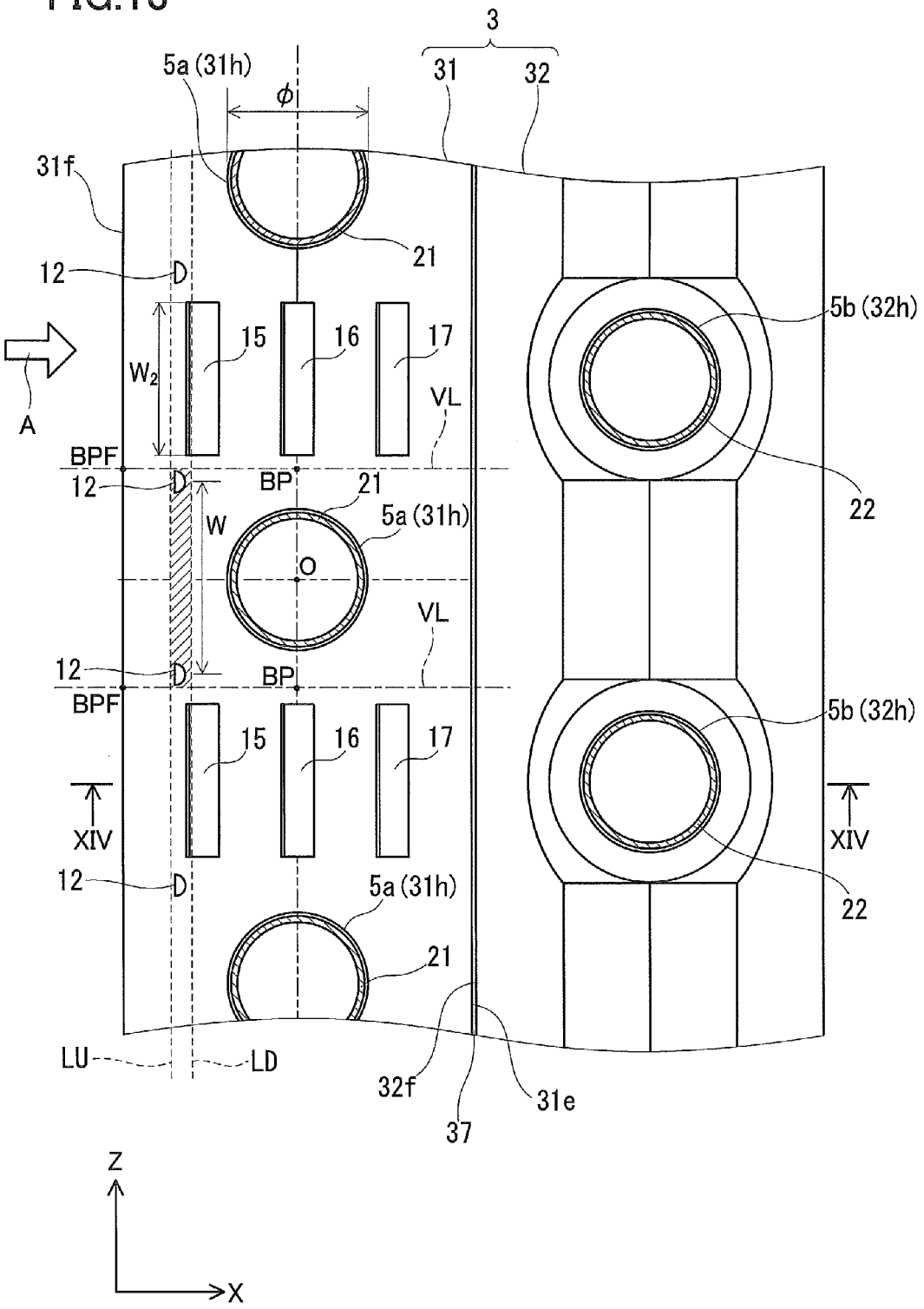
FIG. 13 is a plan view of a fin used in a fin tube heat exchanger according to Modified Embodiment.

In the first fin 31, slit portions 15 to 17 each having a leading edge parallel to the width direction may be formed between two first heat transfer tubes 21 adjacent to each other in the width direction, as shown in FIG. 13. The other portion of the first fin 31 excluding the cut-and-raised portions 12 and the slits 15 to 17 is flat and has a surface parallel to the air flow direction.

The slit portions 15 to 17 are formed at positions farther, in the width direction (Z direction), from the first heat transfer tube 21 than the positions of the cut-and-raised portions 12. Providing the slits 15 to 17 in a region relatively distanced from the first heat transfer tube 21 increases further the effect of suppressing the local frost formation on the leading edge 31*f* of the first fin 31. As a result, the frost becomes uniform in thickness on the surface of the first fin 31 when the frost is formed thereon.

Figure 14:
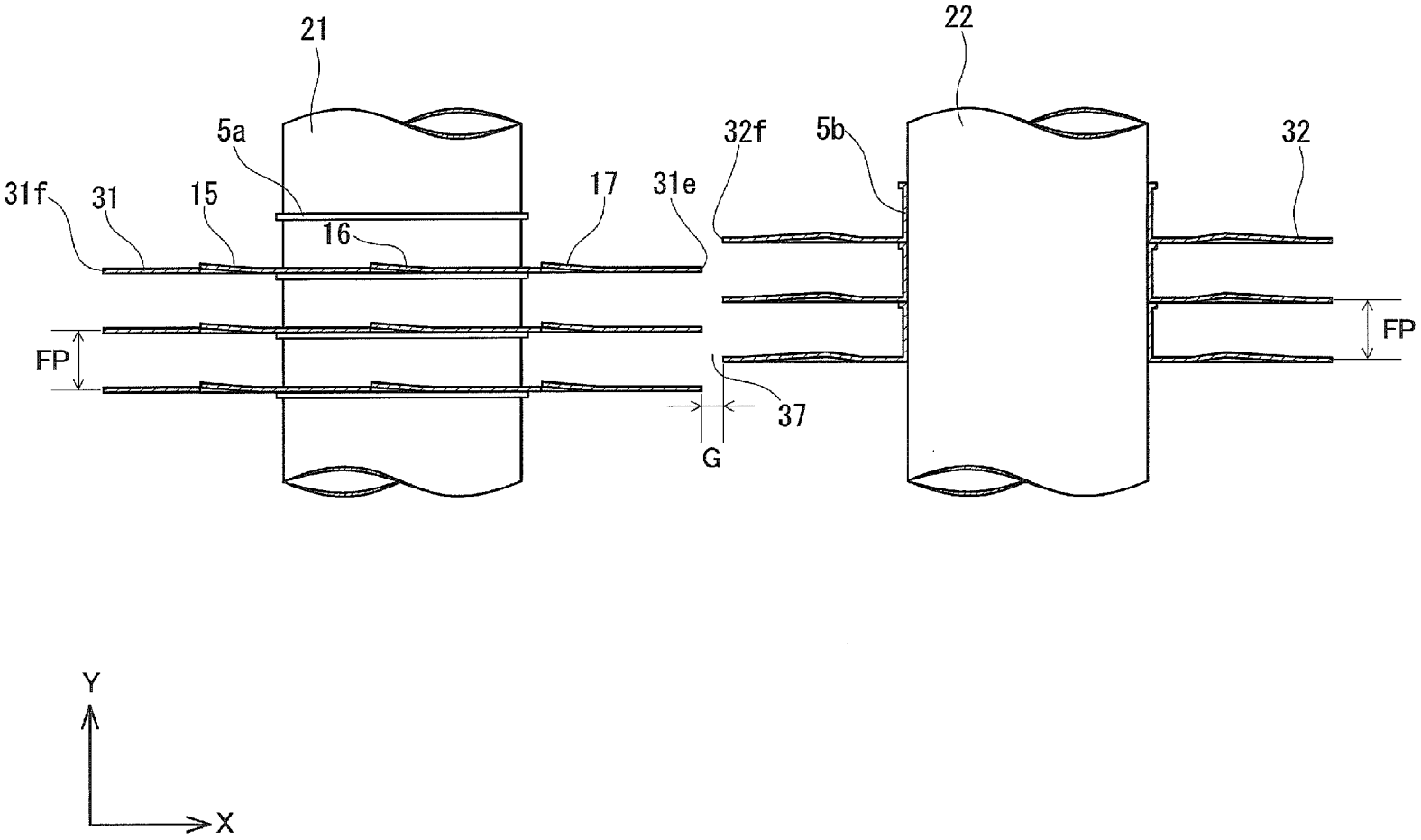
FIG. 14 is a cross-sectional view of the fin tube heat exchanger shown in FIG. 13, taken along the line XIV-XIV.
Figure 15:
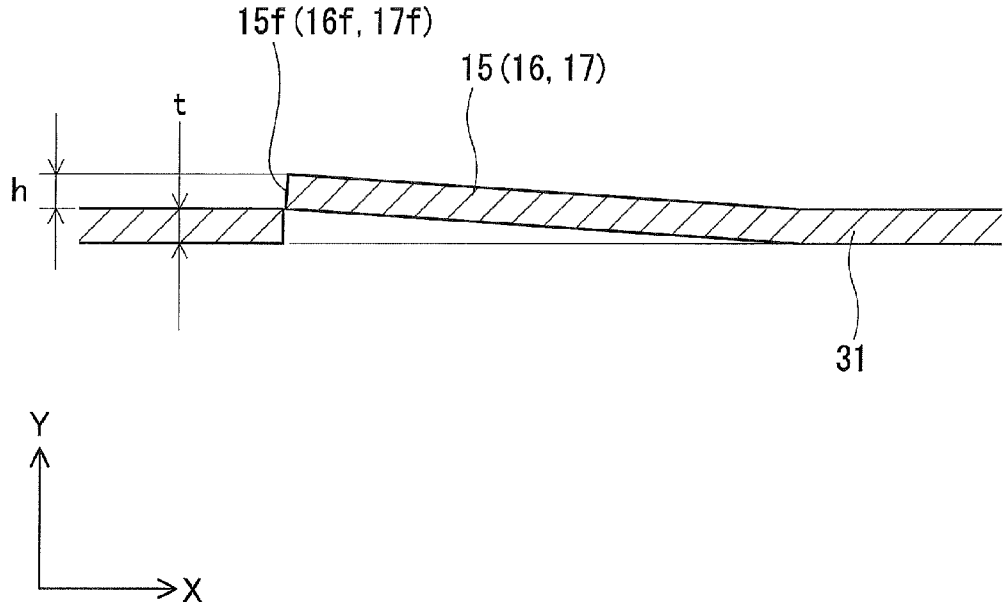
FIG. 15 is an enlarged cross-sectional view of a slit part.

In the present embodiment, the leading edges of the slit portions 15 to 17 form minute level differences on the surface of the first fin 31. As shown in FIG. 14, the protrusion height of the slit portions 15 to 17 from the flat portion of the first fin 31 is very small. Specifically, as shown in FIG. 15, when the thickness of the first fin 31 is referred to as t, the slit portions 15 to 17 have a cut-and-raised height h defined as $0<h<3t$ (preferably $0<h<t$). By setting the cut-and-raised height h of the slit portions 15 to 17 in such a range, it is possible to prevent the slit portions 15 to 17 from increasing the pressure loss. Respective leading edges 15*f* to 17*f* of the slit portions 15 to 17 are parallel to the width direction. By allowing frost to form on the leading edges 15*f* to 17*f*, it is possible to suppress further the local frost formation on the leading edges 31*f* of the first fins 31.

Moreover, in the present embodiment, three slit portions 15 to 17 are formed, along the air flow direction, between two first heat transfer tubes 21 adjacent to each other. Forming a plurality of the slit portions 15 to 17 along the air flow direction in this manner increases further the effect of suppressing the local frost formation on the leading edges 31*f* of the first fins 31. The number of the slit portions may be one, of course.

As shown in FIG. 13, the dimension (width $W_2$) of the slit portions 15 to 17 in the width direction is larger than the diameter $\phi$ of the through holes 31*h*. In the present embodiment, the slit portions 15 to 17 are formed to be equally distanced from two first heat transfer tubes 21 adjacent to each other in the width direction. Increasing the width $W_2$ of the slit portions 15 to 17 increases further the effect of suppressing the local frost formation on the leading edges 31*f* of the first fins 31.

EXAMPLES

A computer simulation was conducted on the fin tube heat exchanger (EXAMPLE) explained with reference to FIG. 10 and FIG. 11 when it was used as an evaporator of a heat pump type water heater (with a heating capacity of 6 kw). Specifically, the thickness of the frost formed on the fin tube heat exchanger was checked by the computer simulation after the fin tube heat exchanger had performed a rated operation for 80 minutes under the winter conditions of 2/1° C. (outside air temperature measured with a dry bulb thermometer/outside air temperature measured with a psychrometer). In addition, the same simulation was conducted on a fin tube heat exchanger (Comparative Example) in which the corrugated fins arranged in two rows, front and back, were used. The design conditions for Example and Comparative Example were as follows. In the simulations, the wind velocity (the amount of wind) was changed according to the formation of frost so that the difference between the pressure at an inlet and pressure at an outlet of the heat exchanger was constant. Such an unsteady state calculation makes it possible to compare only the sheer distributions of frost formations.

Conditions Common Between Example and Comparative Example

Dimensions of fin: Length in air flow direction 18 mm+18 mm, thickness 0.1 mm

Fin pitch: 1.49 mm

Outer diameter of heat transfer tube: 7.0 mm

Refrigerant: $CO_2$

Example

Height H of cut-and-raised portion: 0.75 mm

Length $L_1$ of cut-and-raised portion: 0.75 mm

Comparative Example

Shape: Corrugated fin

Elevation difference between peak and trough: 1.0 mm

Figure 16:
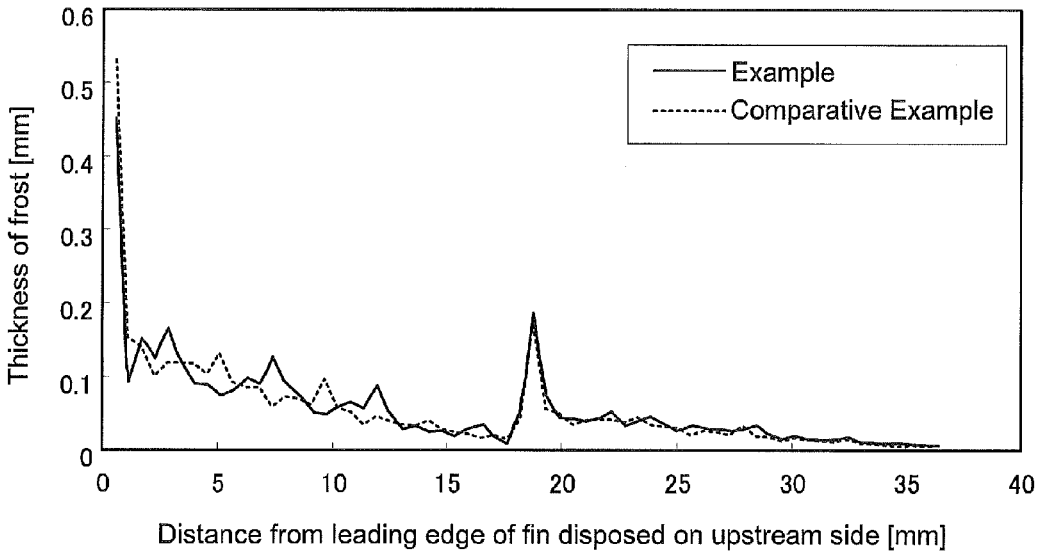
FIG. 16 is a graph showing a relationship between a position from the leading edge of the fin and the thickness of frost.

FIG. 16 shows the results of the simulations. In the graph in FIG. 16, the horizontal axis indicates the distance from the leading edge of the fin (first fin) disposed on the upstream side, and the vertical axis indicates the thickness of the frost. Specifically, FIG. 16 shows a value obtained by averaging, in the width direction, the thickness of the frost formed on the surface of the fin.

As shown in FIG. 16, in Comparative Example, thick frost was formed on the leading edge of the fin disposed on the upstream side. In contrast, in Example, the amount of frost formed on the leading edge of the fin (first fin) disposed on the upstream side was smaller than in Comparative Example.

Figure 17A:
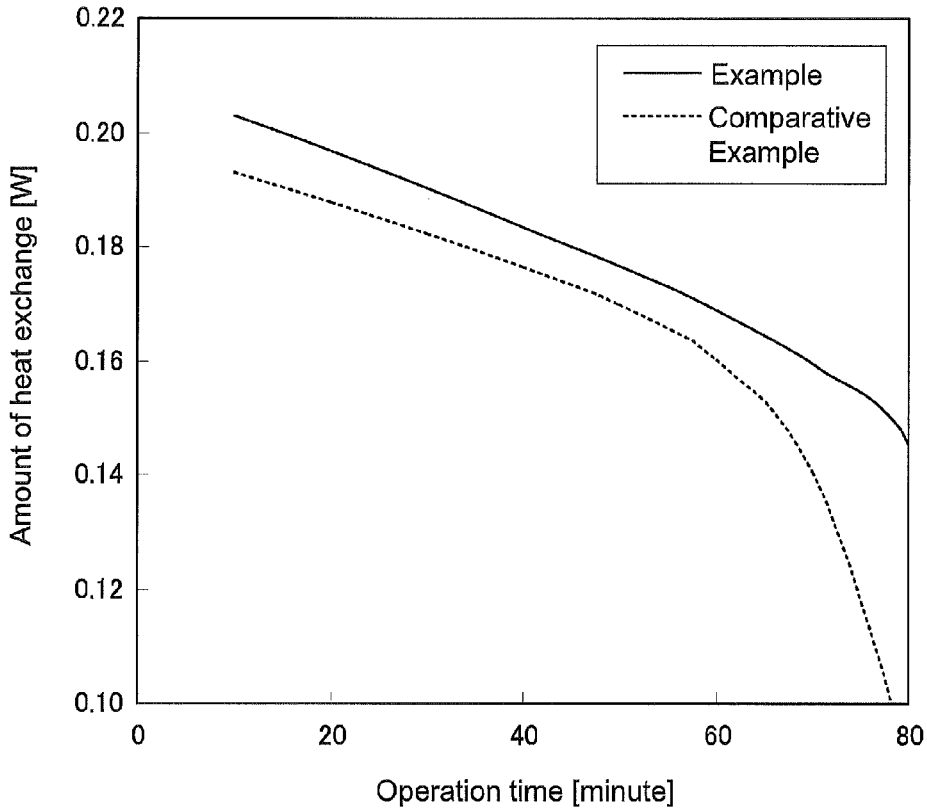
FIG. 17A is a graph showing a relationship between the operation time and the amount of heat exchange.
Figure 17B:
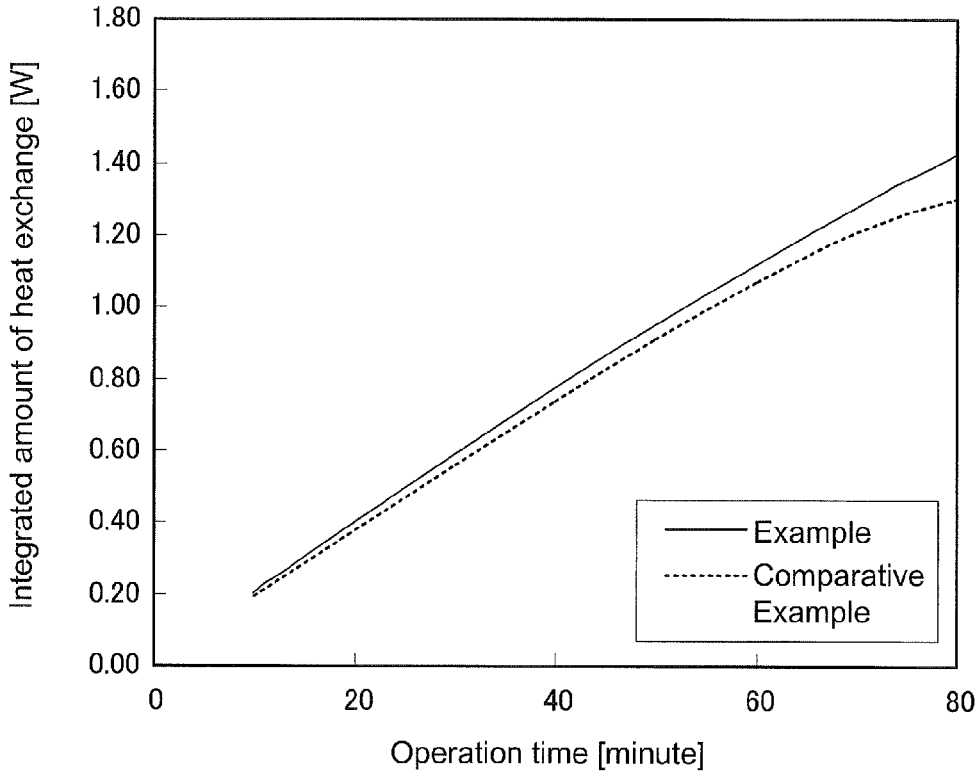
FIG. 17B is a graph showing a relationship between the operation time and the integrated amount of heat exchange.

Moreover, in the simulations, changes with time in the amount of heat exchange and in the integrated amount of heat exchange of the fin tube heat exchangers in Example and Comparative Example were also checked. FIG. 17A and FIG. 17B show the results. The horizontal axes indicate the operation time, and the vertical axes indicate respectively the amount of heat exchange and the integrated amount of heat exchange in the graphs in FIG. 17A and FIG. 17B. In FIG. 17A and FIG. 17B, the amount of heat exchange and the integrated amount of heat exchange are both expressed per analytic area (a surface area of about 76 $mm^2$).

As shown in FIG. 17A, the decrease in the amount of heat exchange in Example was slower than that in Comparative Example. That is, according to Example, a rapid decrease in the heating capacity of a refrigeration cycle and a rapid increase in the temperature of the compressed refrigerant can be suppressed. Moreover, as shown in FIG. 17B, the integrated amount of heat exchange (for 80 minutes) in Example was about 1.08 times larger than that in Comparative Example.

The simulation results above reveal that the fin tube heat exchanger in Example can exhibit a higher capability than those of conventional corrugated fins, and also the local frost formation on the leading edge of the fin can be suppressed in the fin tube heat exchanger. By suppressing the local frost formation on the leading edge of the fin, it is possible to slow the blocking of the air passage and reduce the number of defrostings to be performed. The reduction in the number of defrostings enhances the COP of the refrigeration cycle.

INDUSTRIAL APPLICABILITY

The fin tube heat exchanger according to the present invention is useful for heat pumps used in air conditioners, water heaters, heating apparatuses, etc. Particularly, it is useful for evaporators for evaporating a refrigerant.

The invention claimed is:

1. A fin tube heat exchanger comprising:

a plurality of fins each having a linear leading edge, the fins being arranged parallel to each other at a specified interval to form flow passages for air; and a heat transfer tube through which a medium that exchanges heat with the air flows, the heat transfer tube penetrating through the fins, wherein when: a direction in which the fins are arranged is defined as a height direction; a direction parallel to the leading edge is defined as a width direction; a direction perpendicular to the height direction and the width direction is defined as an air flow direction; a diameter of a through hole formed in each fin in order to allow the heat transfer tube to pass therethrough is defined as $\phi$; a shortest distance from the leading edge to an upstream end of the heat transfer tube is defined as a; a point that is on a surface of the fin and located at a distance, in the width direction, of $0.8\phi$ from a center of the through hole is defined as a reference point; a flat plane that passes the reference point and is perpendicular to the width direction is defined as a reference plane; an intersection between the reference plane and the leading edge when the fin is viewed in plan is defined as a leading edge reference point; a region that is on the surface of the fin, surrounded by line segments connecting among two reference points and two leading edge reference points, and adjacent to the through hole is defined as a reference region;

an imaginary line that is on the surface of the fin and located at a distance of 0.4a from the leading edge is defined as an upstream reference line; similarly a line at a distance of 0.6a from the leading edge is defined as a downstream reference line; and a region that is included in the reference region and located between the upstream reference line and the downstream reference line is defined as a specific region, the fin is provided with a cut-and-raised portion having, in the specific region, another leading edge different from the leading edge, the cut-and-raised portion being formed by cutting and raising a part of the fin, a plurality of the through holes are formed at a constant interval in the width direction, at least one cut-and-raised portion is formed for each of the plurality of through holes, the fins are arranged at a constant fin pitch in the height direction, and when the fin pitch is defined as FP and an interval between two cut-and-raised portions adjacent to each other in the width direction is defined as W, a relationship of $0.5FP<W<5FP$ is satisfied.

2. The fin tube heat exchanger according to claim 1, wherein the another leading edge has a straight line shape or a curved line shape in plan view.

3. The fin tube heat exchanger according to claim 1, wherein the another leading edge of the cut-and-raised portion has a curved line shape that is convex, in plan view, toward an upstream side of the air flow direction, and a most upstream portion of the another leading edge is located in the specific region.

4. The fin tube heat exchanger according to claim 1, wherein the cut-and-raised portion has an opening capable of accepting the air from an upstream side of the air flow direction so as to allow the air to flow from a side of a first main surface of the fin to a side of a second main surface of the fin, and the opening has a semicircular shape or a polygonal shape when viewed from the upstream side of the air flow direction.

5. The fin tube heat exchanger according to claim 1, wherein the cut-and-raised portion has a height H in a range of $0.4FP<H<0.6FP$.

6. The fin tube heat exchanger according to claim 1, further comprising a plurality of second fins disposed on a downstream side of the fins so as to allow the air that has passed through the fins to flow therein, wherein the second fins each is a corrugated fin formed so that a peak and a trough are found alternately along the air flow direction, and a fin pitch of first fins that are the fins having the cut-and-raised portions is the same as a fin pitch of the second fins, and the first fins and the second fins are arranged staggeredly in the height direction and wherein the first fins are non-corrugated.

* * * * *